United States Patent [19]

Freiling

[11] Patent Number: 4,674,406

[45] Date of Patent: Jun. 23, 1987

[54] EXPLOSIVELY ACTIVATED IMPACT SWITCH WITH INTERLOCKING CONTACTS

[75] Inventor: Albert J. Freiling, Finksburg, Md.

[73] Assignee: The United States of America as represented by the Secretary of the Army, Washington, D.C.

[21] Appl. No.: 817,640

[22] Filed: Jan. 10, 1986

[51] Int. Cl.[4] ..... F42C 19/06

[52] U.S. Cl. ..... 102/216; 102/262

[58] Field of Search ..... 102/262, 221, 206, 216, 102/489, 505; 200/52 R, 61.08

[56] References Cited

U.S. PATENT DOCUMENTS

| | | | |
|---|---|---|---|
| 2,454,281 | 11/1948 | Hicks | 102/489 |
| 3,698,323 | 10/1972 | Apstein et al. | 102/262 |
| 4,178,855 | 12/1979 | McVay et al. | 102/262 |
| 4,335,655 | 6/1982 | Lofgren | 102/505 |

*Primary Examiner*—Charles T. Jordan

*Attorney, Agent, or Firm*—Saul Elbaum; Alan J. Kennedy; Thomas E. McDonald

[57] ABSTRACT

A method and apparatus for detonating an explosive in response to the detonation of a remote explosive without damaging any components positioned intermediate the two explosives. An impact switch having contact elements that permanently interlock when activated is positioned adjacent to one of the explosives. A power supply is connected to the impact switch, and the output from the power supply is connected to the detonator for the second explosive. When the first explosive is detonated, the contact elements of the impact switch close, permanently interlocking. This completes and activates an electrical circuit with the power supply that sends current to the detonator of the second explosive to initiate detonation of the second explosive. The preferred embodiment positions the impact switch with the power supply adjacent to an electronic time fuze detonator and lead charge at the forward end of a cargo-carrying projectile, whereas the second explosive is positioned at the rear of the projectile for initiating ejection of a payload. In another embodiment the current from the power supply is also used to sequentially start a series of timer circuits that will detonate a series of explosive charges to sequentially eject a series of payload cargoes from a projectile.

4 Claims, 6 Drawing Figures

EXPLOSIVELY ACTIVATED IMPACT SWITCH WITH INTERLOCKING CONTACTS

RIGHTS OF THE GOVERNMENT

The invention described herein may be manufactured, used and licensed by or for the United States Government for governmental purposes without the payment to me of any royalty thereon.

BACKGROUND OF THE INVENTION

1. Field of the Invention

The present invention is related to projectiles and, more particularly, is directed toward a technique and device which permits an explosive charge located in one portion of a projectile to be detonated in response to detonation of an explosive charge positioned in another portion of the projectile.

2. Description of the Prior Art

There exists in the family of military projectiles a cargo round which is designed to carry various payloads and eject them during flight. Such cargo may comprise, for example, radio jamming devices, and it is generally desired to eject such devices from the projectile at a predetermined point in time after the projectile has been launched. Cargo is normally ejected from the rear or base of the projectile by detonating an explosive charge which acts to remove a base plug from the projectile permitting the cargo to be ejected.

Detonation of the charge in the base of the projectile may be initiated by an electronic time fuze positioned at the forward portion of the projectile. Such a time fuze is preset to detonate its own explosive at a predetermined period of time after the projectile is launched. A problem exists in effectively translating the explosive charge of the time fuze into an electrical signal which may be utilized to detonate the explosive at the rear of the projectile.

A high explosive detonating cord known as Primacord has been used in the past to transmit a detonation from one point to another at the other end of the cord. Such a device, however, is unsuitable for the application discussed above, since the cord itself is detonated and anything along the path of the cord stands to be damaged or destroyed. Thus, the payload in the cargo projectile between the fuze and the rear base plug would be subjected to damage or destruction.

A need, therefore, arose to provide such a cargo-carrying projectile with a means for utilizing the explosive charge at the front end of the projectile to detonate the charge at the rear of the projectile, without destroying the payload positioned between the charges.

An early solution to this problem is taught in U.S. Pat. No. 4,335,655 which discloses a device for detonating an explosive in response to the detonation of a remote explosive without damaging any components positioned intermediate the two explosives. In this patent a permanent magnet having a coil of wire positioned about it is placed adjacent to one of the explosives, ad the output from the coil is connected to the detonator for the second explosive. When the first explosive is detonated, the permanent magnet is destroyed to thereby collapse the magnetic field traversing the coil. The collapse of the magnetic field generates a voltage which is transmitted to the detonator for the second explosive for initiating detonations of that second explosive. There however are some shortcomings with the device disclosed in U.S. Pat. No. 4,335,655 in that the voltage pulse generated by this switch lasts for only a few microseconds. It is, therefore, not adequate in situations where a continuous voltage is required to detonate a series of explosive charges or to sequentially send an electrical signal to other electrical or electronic components.

In addition there was also a critical need to develop a switch mechanism in which, upon activation of the switch, the contact elements would remain fully closed to provide a continuous voltage pulse that lasts for several seconds; i.e, the switch elements must be prevented from bouncing apart and accidentally reopening the electrical circuit.

OBJECTS AND SUMMARY OF THE INVENTION

It is therefore a primary object of the present invention to provide an explosively activated switch mechanism in which the contact elements will remain fully closed upon actuation.

Another object of the present invention is to provide an apparatus, which responds to an explosive charge, for switching in a separate voltage source to detonate a remotely located detonator.

Another object of this invention is to provide an electrical switch that will produce a long voltage pulse for starting one or more remotely located timer circuits in response to detonation of a first explosive which is simple and inexpensive to fabricate, highly reliable in operation and is insensitive to setback forces to which the device may be subjected to during launch.

A further object of the present invention is to provide a method and apparatus for detonating one explosive in response to the detonation of another remotely located explosive without destroying anything positioned between the two explosives.

The foregoing and other objects are attained in accordance with one aspect of the present invention through the provision of an apparatus which comprises an impact switch with interlocking contact elements that are connected to a power supply that produces a continuous voltage such that the switch is responsive to the detonation of a first explosive positioned at the forward end of a projectile, and means for transmitting the voltage signal to means for detonating a second explosive positioned at the rear of the projectile.

The impact switch means more particularly comprises a top plate contact element and a bottom plate contact element which are connected to a power supply such as a battery. The plate of the impact switch is positioned adjacent the first explosive and is plastically deformed such that the contact element of the top plate is permanently interlocked or joined to the contact element of the bottom plate. Since the impact switch is connected to a power supply, a current is produced that is transmitted via electrical wires to the means for detonating the second explosive.

In another embodiment, the current from the power supply is also used to sequentially start a series of timer circuits that will detonate a series of explosive charges to sequentially eject a series of payload or cargoes from a projectile.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENT

Figures 1, 2, 3, 4:
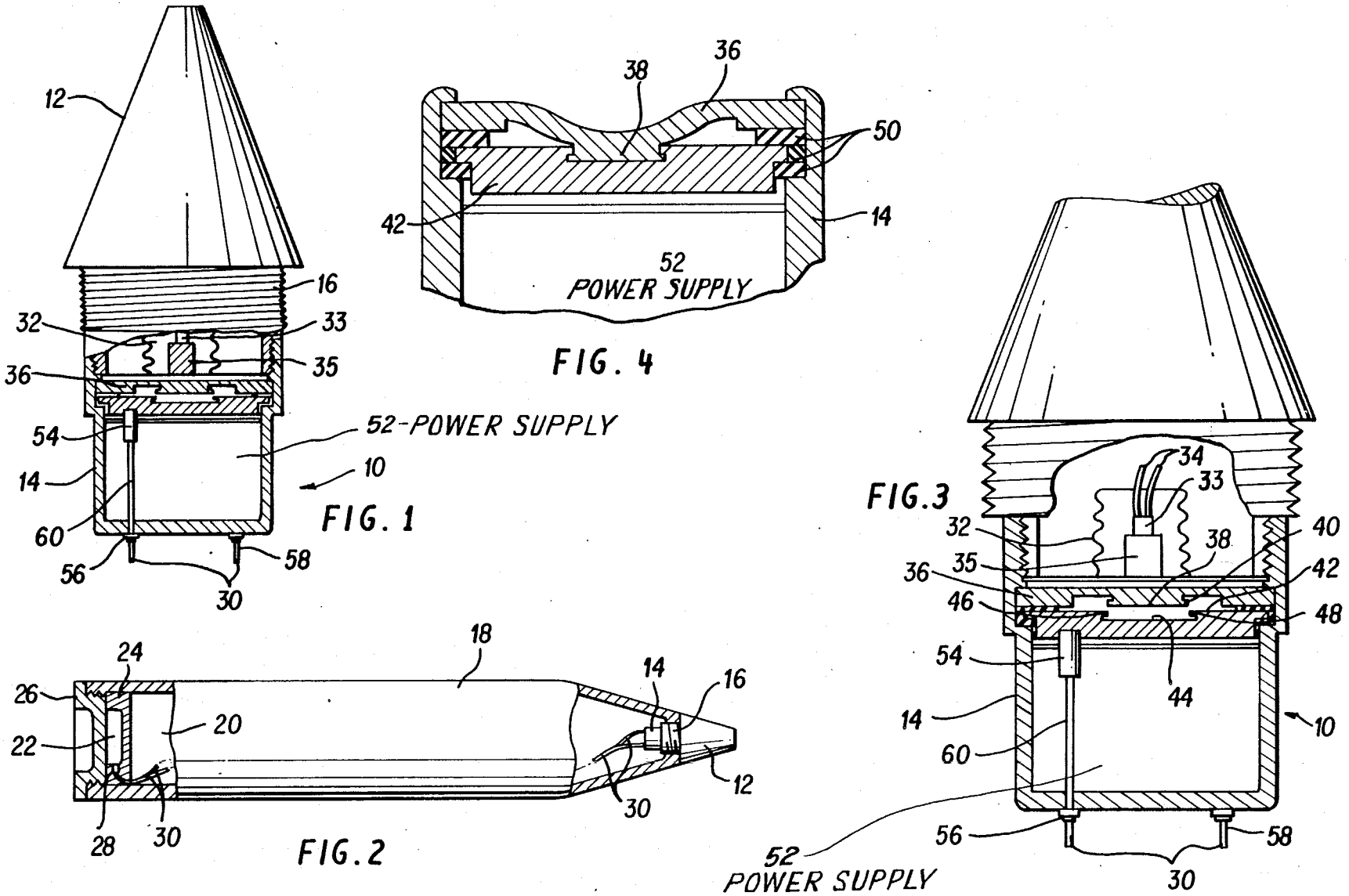
FIG. 1 is a side view, partly in section, illustrating a time fuze having a preferred embodiment of the present invention incorporated therein.
FIG. 2 is a side view, partly in section, which shows the preferred embodiment of the present invention mounted in a cargo-carrying projectile.
FIG. 3 is an enlarged, cross-sectional view of the preferred embodiment of the present invention, showing the impact switch with its contact elements in the open position.
FIG. 4 is an enlarged, cross-sectional view of the impact switch showing its contact elements in the closed position.

Referring now to the drawings, wherein like reference numerals represent identical or corresponding parts throughout the several views, and more particularly to FIGS. 1 and 2 thereof, the preferred embodiment of the present invention is indicated generally by reference numeral 10.

The device 10 of the present invention is shown positioned in the rearward portion of an electronic or mechanical time fuze 12 which includes a rewardly extending fuze housing or body 14 having threads 16 for securing same to the forward portion of a cargo-carrying projectile 18.

The projectile 18 with which the present invention is particularly designed to be utilized includes one or a plurality of cargo packages or payloads 20 which may comprise, for example, radio jamming devices. The payload 20 is desired to be ejected from the projectile 18 a predetermined time after the projectile is launched. To accomplish ejection, the rear portion of the projectile 18 is provided with an ejector charge 22 which is detonated by means of an electric detonator 28 positioned adjacent thereto. A base plug ejector 24 comprises a plate which is designed to eject the base plug 26 from the rear of the projectile 18 upon detonation of charge 22. As is conventional, the cargo package 20 may be provided with its own propulsive charge to eject it from the body of projectile 18 after the base plug 26 has been blown away. The details of construction of projectile 18 and its associated base plug and ejector means are well-known to a person of ordinary skill in the art, and therefore need not be described in greater detail than heretofore given.

In FIG. 2 is illustrated electrical lead wires 30 which are connected between the present invention 10 and the rear detonator 28, for a purpose which will become clearer hereinafter.

Referring now to FIG. 3, a vertical cross-section of the fuze housing 14 is illustrated. As is conventional, the fuze 12 is provided with an explosive train 32 in the central portion thereof which responds to an electrical signal along wires 34 for detonating same. The signal on wires 34 may be provided by any conventional electronic or mechanical timing means, well-known to a person of ordinary skill in this art. The explosive train 32 consists of, for example, a detonator 33, and lead charge 35.

Positioned adjacent and rearwardly of the explosive train 32 of the fuze 12 is top plate 36 of impact switch assembly 10. The lower portion of top contact plate 36 has formed in it penetrator disc 38 with an annular rim 40 extending from the outer edge of penetrator disc 38. Positioned beneath top plate 36 is bottom contact plate 42, having socket 44 positioned directly below penetrator disc 38. Socket 44 has annular ring 46 extending from its upper portion. It should be noted that the diameter of annular rim 40 is slightly larger than the diameter of annular ring 46, but the diameter of annular rim 40 is less than the diameter of the lower portion of socket 44. Insulation 50, shown in FIG. 4, is placed about the outer edge surfaces of bottom contact plate 42 to keep the contact plates 36, 42 separated prior to activation of the switch. In the preferred embodiment the contact plates 36, 42 are made of steel; however, they could be made of any suitable material that is electrically conductive. It is not necessary that the entire contact plate be electrically conductive; however, that portion of the external surfaces of contact plates 36, 42 that is required to complete an electrical circuit or path must be coated with an electrically conductive material.

Bottom contact plate 42 is affixed to power supply 52 by means of brass contact lug 54. The power supply 52 in this case is a battery having positive terminal 56 connected to contact lug 54 by way of terminal wire 60 and having ground terminal 58 positioned at the base of power supply 52.

Shown extending from power supply 52 are electrical leads 30 that terminate in electric detonator 28 positioned at the rear of the projectile 18, or in any other remote location.

In operation, when the explosive charge 32 is detonated by action of the time fuze 12, the explosion produces a plastic deformation of top contact plate 36 as is shown in FIG. 4. This in turn forces penetrator disc 38 through annular ring 46 into socket 44, interlocking top contact plate 36 with bottom contact plate 42. Since contact plates 36 and 42 are connected to power supply 52 an electrical circuit is now complete and activated, sending current via wires 30 to electric detonator 28 to initiate its detonation.

Figure 5:
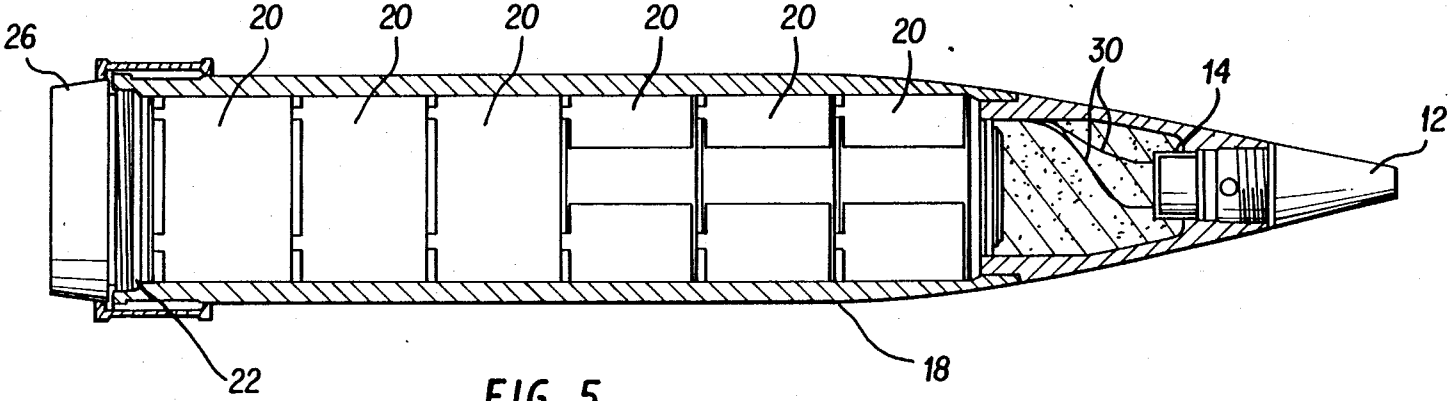
FIG. 5 is a side view, partly in section, of the preferred embodiment the present invention mounted in a cargo-carrying projectile containing multiple payloads that are to be sequentially ejected from the projectile.
Figure 6:
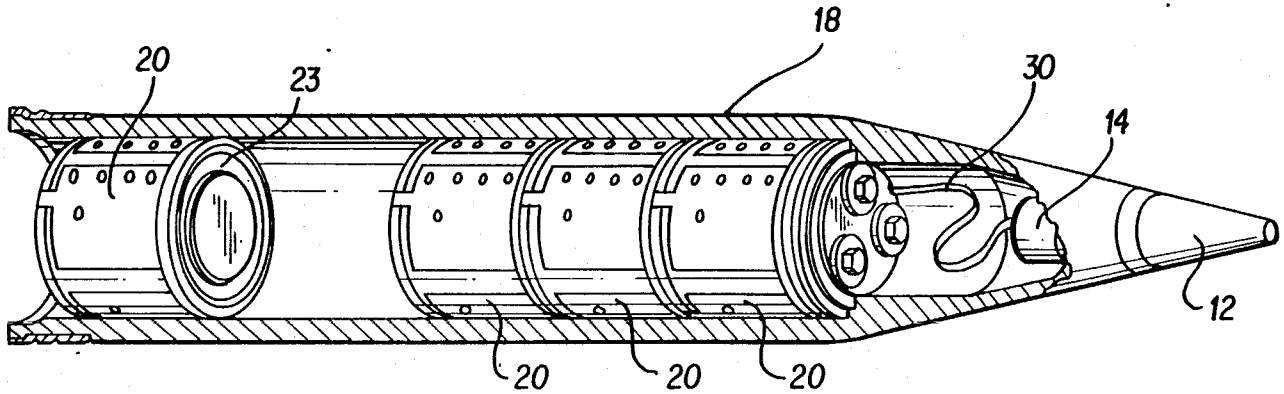
FIG. 6 is a side view, partly in section, of the preferred embodiment of the present invention mounted in a cargo-carrying projectile showing one of the multiply payloads shown in FIG. 5 being ejected from the projectile.

The improvement that this device provides over existing systems is that it allows for a longer voltage pulse to be applied to electric detonator 28. This is important for another embodiment of this invention where the payload 20 is comprised of a series of electronic jamming devices as is shown in FIG. 5. In this embodiment the current signal which is sent through wires 30 is also used to supply an impulse to several inductors (not shown) which are contained in the sidewall of each jammer 20. This signal is used to start a pre-set electronic timer circuit in each jammer. This timer circuit initiates another ejector charge 23 such as a gas generator, as is shown in FIG. 6, and the jammers 20 are thus sequentially ejected from projectile 18 during its down range flight. Switch 10 is thus an explosively actuated, battery powered switch that may be employed with any type of artillery or mortar round that uses a nose fuze as a means for firing at a pre-set time.

Obviously, numerous modifications and variations of the present invention are possible in light of the above teachings. It is therefore to be understood that within the scope of the appended claims, the invention may be practiced otherwise than as specifically described herein.

I claim:

1. An apparatus for releasing a payload from a projectile comprising:

a means for securing said payload positioned on the rear of said projectile;

a first explosive charge positioned at the forward end of said projectile;

a fuze for detonating said first explosive charge;

a switch means positioned adjacent to said first explosive charge;

a second explosive charge positioned adjacent said means for securing; and means for detonating said second explosive charge in response to the detonating of said first explosive charge whereby said payload is released;

wherein said switch means is an impact switch further comprising a top contact plate having a penetrator disc member and a bottom contact plate having a socket, wherein when said first explosive charge is detonated, said top plate is plastically deformed causing said top plate to permanently interlock with said bottom plate.

2. The apparatus of claim 1 wherein said contact plates of said impact switch are connected to a power supply such that a closed electric circuit is created when said impact switch is explosively activated by said first explosive charge.

3. A method of detonating a second explosive charge positioned remotely from and in response to a first explosive charge without damaging components positioned between said first and second charges, comprising the steps of:

positioning an impact switch, having contact plates that permanently interlock in the closed position, adjacent to said first explosive charge;

connecting the contact plates of the impact switch to a power supply;

connecting the electrical wire between said power supply and means for detonating said second explosive charge; and detonating said first explosive charge to cause said impact switch contacts to close thereby initiating current to flow in said electrical wire to detonate said second explosive charge.

4. The method of claim 3 wherein the current flow in said wires is utilized to detonate a plurality of charges, in sequence, and subsequent to said detonation of said second explosive charge.

* * * * *